US010595130B2

(12) United States Patent
Tanabe

(10) Patent No.: US 10,595,130 B2
(45) Date of Patent: Mar. 17, 2020

(54) SPEAKER

(71) Applicant: ALPINE ELECTRONICS, INC., Ota-ku, Tokyo (JP)

(72) Inventor: Kei Tanabe, Iwaki (JP)

(73) Assignee: ALPINE ELECTRONICS, INC., Tokyo (JP)

( * ) Notice: Subject to any disclaimer, the term of this patent is extended or adjusted under 35 U.S.C. 154(b) by 0 days.

(21) Appl. No.: 16/032,766

(22) Filed: Jul. 11, 2018

(65) Prior Publication Data

US 2019/0082263 A1 Mar. 14, 2019

(30) Foreign Application Priority Data

Sep. 14, 2017 (JP) ..... 2017-176975

(51) Int. Cl.

| | |
|---|---|
| ***H04R 9/02*** | (2006.01) |
| ***H04R 9/04*** | (2006.01) |
| ***H04R 7/18*** | (2006.01) |
| ***H04R 7/02*** | (2006.01) |
| ***H04R 7/06*** | (2006.01) |
| ***H04R 9/06*** | (2006.01) |

(52) U.S. Cl.

CPC ..... *H04R 9/022* (2013.01); *H04R 7/02* (2013.01); *H04R 7/18* (2013.01); *H04R 9/025* (2013.01); *H04R 9/04* (2013.01); *H04R 9/06* (2013.01); *H04R 2400/11* (2013.01)

(58) Field of Classification Search

CPC . H04R 9/022; H04R 7/02; H04R 7/18; H04R 9/025; H04R 9/04; H04R 9/06; H04R 2100/11

USPC ..... 381/184, 412, 397, 398, 400

See application file for complete search history.

(56) References Cited

U.S. PATENT DOCUMENTS

| | | | | |
|---|---|---|---|---|
| 6,229,902 | B1 | 5/2001 | Proni | |
| 2005/0041831 | A1* | 2/2005 | Stiles | H04R 9/022 381/412 |
| 2006/0093180 | A1* | 5/2006 | Kim | H04R 9/025 381/412 |
| 2009/0180648 | A1* | 7/2009 | Endo | H04R 1/24 381/184 |
| 2010/0329497 | A1 | 12/2010 | Perovic | |
| 2011/0116662 | A1* | 5/2011 | Yuze | H04R 9/025 381/184 |
| 2015/0289039 | A1 | 10/2015 | Prokisch | |

FOREIGN PATENT DOCUMENTS

| | | |
|---|---|---|
| JP | 64-40995 | 3/1989 |
| JP | 8-102994 | 4/1996 |

OTHER PUBLICATIONS

Extended European Search Report for 18192967.0 dated Dec. 10, 2018, 7 pgs.

* cited by examiner

*Primary Examiner* — Binh Kien Tieu
(74) *Attorney, Agent, or Firm* — Brinks Gilson & Lione

(57) ABSTRACT

A speaker includes spacers that are disposed between a front end portion of a top yoke, which serves as a first member, and a back end portion of a back portion of a frame, which serves as a second member, to form a gap that defines an air passage. When a bobbin and a vibrating plate vibrate in a front-back direction, an airflow through the air passage, which faces a voice coil, is formed between the space around a magnetic gap and the outside. Accordingly, the voice coil is cooled over the entire circumference thereof.

16 Claims, 3 Drawing Sheets

SPEAKER

RELATED APPLICATION

The present application claims priority to Japanese Patent Application Number 2017-176975, filed Sep. 14, 2017, the entirety of which is hereby incorporated by reference.

BACKGROUND

1. Field of the Invention

The present invention relates to a speaker having a structure capable of reducing a temperature increase due to heat generated by a voice coil.

2. Description of the Related Art

Japanese Unexamined Patent Application Publication No. 8-102994 (hereinafter referred to as Patent Document 1) and Japanese Unexamined Utility Model Registration Application Publication No. 64-40995 (hereinafter referred to as Patent Document 2) describe speakers for reducing a temperature increase due to heat generated by a voice coil.

The speaker described in Patent Document 1 includes a magnetic circuit unit including a back plate, a center pole provided at the center of the back plate, a magnet fixed to an outer peripheral portion of the back plate, and a top plate disposed at the front of the magnet. A magnetic gap is formed between an outer peripheral surface of the center pole and an inner peripheral surface of the top plate, and a voice coil wound around a bobbin is disposed in the magnetic gap.

In an embodiment illustrated in FIG. 5 of Patent Document 1, four heat dissipation grooves that extend radially in respective directions are formed in an adhesion surface of the top plate that is bonded to the magnet. The speaker emits a sound when a vibrating plate vibrates together with the voice coil in a front-back direction. According to the document, heat that accumulates in a space around the voice coil is dissipated outward through the grooves.

The speaker illustrated in FIG. 1 of Patent Document 2 includes a disc-shaped spacer made of a non-magnetic material disposed between a plate fixed to the front of a main magnet and an iron frame that supports a vibrating plate. The spacer serves to reduce magnetic flux leakage from attachment surfaces of the plate and the frame. A plurality of radially extending grooves are formed in a surface of the spacer that is attached to the frame. When the vibrating plate vibrates in a front-back direction, external air flows inward through the grooves and cools the voice coil.

In the speakers according to Patent Documents 1 and 2, heat dissipation grooves are formed in a plate made of a magnetic material or a spacer made of a non-magnetic material. These structures have the following problems:

(1) Since cooling airflows are formed in a plurality of narrow, shallow grooves, sufficient heat dissipating effect cannot be obtained. In addition, heat is dissipated from the above-described space unevenly between the regions in which the grooves are formed and regions in which no grooves are formed.

(2) When the vibrating plate vibrates in the front-back direction, air passes through the narrow, shallow grooves. Therefore, when the amplitude of the vibrating plate increases, the flow rate of the air that passes through the grooves increases, and air suction noise and air discharge noise increase accordingly. The air suction noise and air discharge noise easily leak to the outside as air noise.

(3) In the speaker according to Patent Document 1, a plurality of grooves need to be formed in the plate. In the speaker according to Patent Document 2, a plurality of grooves need to be formed in the spacer. Accordingly, the processing cost is increased.

SUMMARY

The present invention solves the above-described problems of the related art, and an object of the present disclosure is to provide a speaker capable of providing a sufficient heat dissipating effect and reducing air noise by forming an air passage for generating an airflow so that the air passage faces a voice coil over the entire circumference thereof.

According to the present disclosure, a speaker includes a support body including a frame and a magnetic circuit unit fixed to the frame; a vibrating plate supported by the frame in such a manner that the vibrating plate is capable of vibrating in a front-back direction; a bobbin fixed to the vibrating plate; and a voice coil wound around the bobbin and disposed in a magnetic gap provided in the magnetic circuit unit.

The support body includes a first member and a second member located in front of the first member, the first member having a front end portion that faces forward, the second member having a back end portion that faces backward.

The first member and the second member are fixed so that the front end portion and the back end portion are spaced from each other in the front-back direction and have a gap provided between, the gap facing an outer periphery of the voice coil at least when the bobbin is stationary at a neutral position in the front-back direction.

In the speaker according to the present disclosure, the gap may face the voice coil all around the voice coil.

In the speaker according to the present disclosure, the front end portion of the first member and the back end portion of the second member may both be flat surfaces. However, at least one of the front end portion and the back end portion may be an irregular surface or a grooved surface.

In the speaker according to the present disclosure, preferably, the first member is a yoke included in the magnetic circuit unit, and the second member is a portion of the frame.

In the speaker according to the present disclosure, the first member and the second member may be fixed with a spacer provided between the front end portion and the back end portion.

For example, the spacer may be one of a plurality of spacers arranged around a winding center line of the voice coil with intervals therebetween.

In the speaker according to the present disclosure, the first member and the second member may be fixed together by a fixing member with the gap provided between the front end portion and the back end portion.

According to the speaker of the present disclosure, it is not necessary to form grooves or the like in a member of the support body, and the gap can be formed so as to face the outer periphery of the voice coil over a large area. The gap that faces the voice coil over substantially the entire circumference thereof has a large opening capacity. Therefore, when the vibrating plate vibrates, heat radiated from the voice coil can be easily dissipated to the outside. In addition, the air suction noise and air discharge noise generated when the vibrating plate vibrates can be reduced, and air noise that leaks to the outside can be reduced accordingly.

DETAILED DESCRIPTION OF THE PREFERRED EMBODIMENTS

Figure 1:
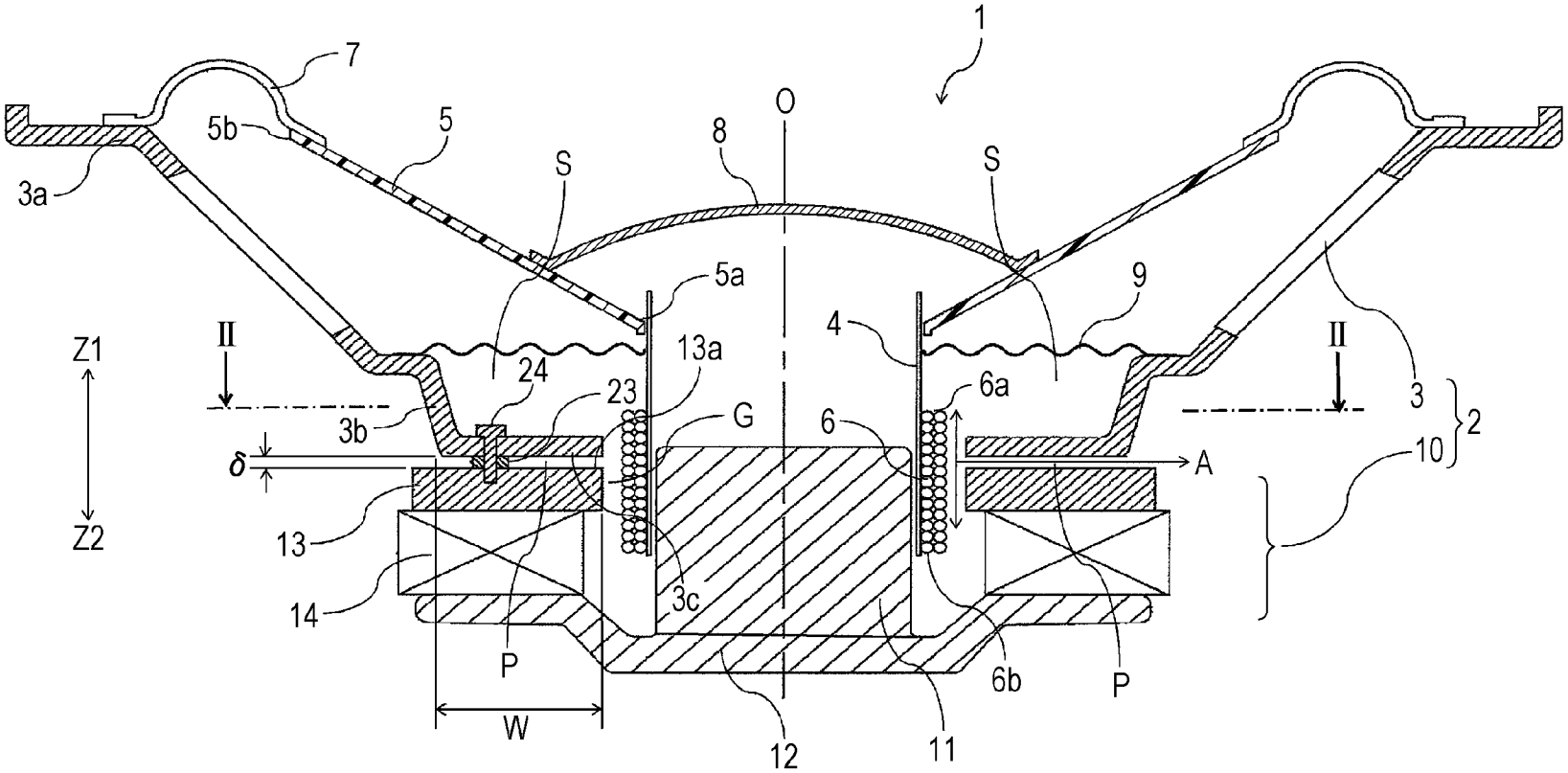
FIG. 1 is a sectional view of a speaker according to a first embodiment of the present invention oriented so that sound is emitted upward.

FIG. 1 illustrates a speaker 1 according to a first embodiment of the present invention.

The speaker 1 includes a frame 3 and a magnetic circuit unit 10 fixed at the back (Z2-side) of the frame 3. The frame 3 and the magnetic circuit unit 10 form the support body 2.

The frame 3 is formed of a non-magnetic material or a magnetic material by, for example, die-casting by using a metal, injection molding by using a synthetic resin, or sheet metal working by using a metal sheet.

The magnetic circuit unit 10 includes a center pole 11 located at the center, a bottom yoke 12 fixed to the back (Z2-side) of the center pole 11, a top yoke 13 that faces the front (Z1-side) of an outer peripheral portion of the bottom yoke 12, and a magnet 14 fixed between the bottom yoke 12 and the top yoke 13. The center pole 11, the bottom yoke 12, and the top yoke 13 are formed of a magnetic metallic material. The magnet 14 is a ring-shaped permanent magnet, and has a center hole in which the center pole 11 is disposed. The magnet 14 is magnetized so that a front surface (Z1-side surface) and a back surface (Z2-side surface) thereof have different magnetic poles. A magnetic gap G is formed in a region where an outer peripheral surface of the center pole 11 and an inner peripheral surface of the top yoke 13 that face each other.

A bobbin 4 and a vibrating plate 5 are disposed in the support body 2 formed of the frame 3 and the magnetic circuit unit 10.

The bobbin 4 is a hollow cylinder having a perfect circular cross section. The bobbin 4 is made of paper or a synthetic material composed of paper and a synthetic resin. Alternatively, the bobbin 4 is made of a synthetic resin material. A voice coil 6 is provided on a back portion (Z2-side portion) of the bobbin 4. The bobbin 4 and the voice coil 6 are disposed in the magnetic gap G. The voice coil 6 is formed by winding a coil wire, which is a coated wire, multiple turns around the bobbin 4.

FIG. 1 shows a winding center line O of the voice coil 6. The winding center line O coincides with the center line of the speaker 1 extending in the front-back direction.

The vibrating plate 5 is conical, and is made of paper or a synthetic material composed of paper and a synthetic resin. Alternatively, the vibrating plate 5 is made of a synthetic resin material. An inner peripheral portion 5*a* of the vibrating plate 5 is bonded to an outer peripheral surface of a Z1-side end portion of the bobbin 4. An edge member 7 is provided between a Z1-side edge portion 3*a* of the frame 3 and an outer peripheral portion 5*b* of the vibrating plate 5. The edge member 7 is made of cloth, a foamed resin material, or a combination thereof so that the edge member 7 is flexibly deformable. A cap member 8 is fixed to an inner surface of a Z2-side portion of the vibrating plate 5. The cap member 8 covers an opening of the bobbin 4 that faces forward (Z1 direction) from the front.

A damper member 9 is provided between the outer peripheral surface of the Z1-side portion of the bobbin 4 and an inner surface of a Z2-side portion of the frame 3. The damper member 9 is made of cloth, a synthetic material composed of cloth and a synthetic resin, or a synthetic resin material so that the damper member 9 is not air permeable. The damper member 9 is corrugated and is wavy in cross section.

In the speaker 1 illustrated in FIG. 1, a gap having a width δ in the front-back direction is provided between a front end portion 13*a* of the top yoke 13, which is a component of the magnetic circuit unit 10, and a back end portion 3*c* of a back portion 3*b* of the frame 3. The front end portion 13*a* faces forward (Z1 direction), and the back end portion 3*c* faces backward (Z2 direction). The gap serves as an air passage P. In the first embodiment illustrated in FIG. 1, the top yoke 13 serves as a first member of the support body 2, and the back portion 3*b* of the frame 3 serves as a second member of the support body 2. As described above, the support body 2 is formed of the frame 3 and the magnetic circuit unit 10.

Figure 2:
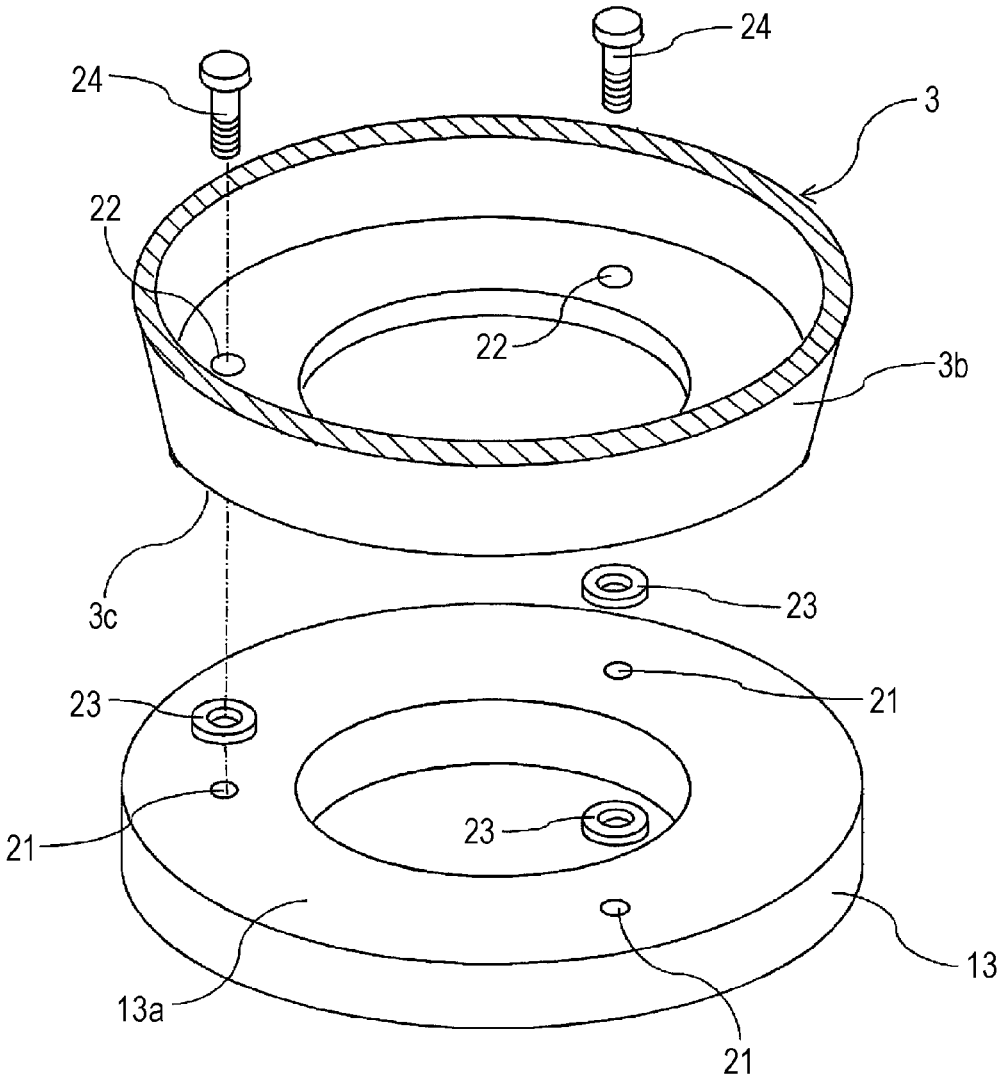
FIG. 2 is an exploded perspective view of a portion of a member of a support body of the speaker illustrated in FIG. 1, the portion being cut along line II-II in FIG. 1.

As illustrated in FIG. 2, the front end portion 13*a* of the top yoke 13, which is the first member, and the back end portion 3*c* of the back portion 3*b* of the frame 3, which is the second member, are both flat surfaces. A plurality of threaded holes 21 are formed in the front end portion 13*a* of the top yoke 13 at different positions. The threaded holes 21 are arranged in a circumferential direction around the winding center line O at angular intervals of 120 degrees. Attachment holes 22 are formed at the bottom of the back portion 3*b* of the frame 3. The attachment holes 22 are also arranged in the circumferential direction around the winding center line O at angular intervals of 120 degrees. A plurality of ring-shaped spacers 23 are disposed between the front end portion 13*a* of the top yoke 13 and the back end portion 3*c* of the back portion 3*b* of the frame 3. Fixing screws 24 are inserted through the attachment holes 22 from the front. The fixing screws 24 are inserted through center holes in the spacers 23, and threaded portions at the ends of the fixing screws 24 are screwed into the threaded holes 21.

As illustrated in FIG. 1, when the fixing screws 24 are fastened, the width of the gap between the front end portion 13*a* of the top yoke 13 and the back end portion 3*c* of the back portion 3*b* of the frame 3 is maintained at 6, and the air passage P is formed. The width (gap width) δ of the air passage P in the front-back direction (Z1-Z2 direction) is determined by the thickness of the spacers 23.

When no voice current is applied to the voice coil 6 and when the bobbin 4 and the vibrating plate 5 supported by the edge member 7 and the damper member 9 are stationary at neutral positions in the front-back direction (Z1-Z2 direction), the air passage P faces the outer periphery of the voice coil 6. More specifically, when the bobbin 4 and the vibrating plate 5 are at the neutral positions, the back end portion 3*c* of the back portion 3*b* of the frame 3 is on the Z2 side of a Z1-side end portion 6*a* of the voice coil 6, and the front end portion 13*a* of the top yoke 13 is on the Z1 side of a Z2-side end portion 6*b* of the voice coil 6.

Preferably, the air passage P constantly faces the outer peripheral portion of the voice coil 6 also when a voice current is applied to the voice coil 6 and when the bobbin 4 and the vibrating plate 5 vibrate in the front-back direction at a maximum amplitude.

The air passage P faces the outer periphery of the voice coil 6 over the entire circumference of 360 degrees around the winding center line O of the voice coil 6. In FIG. 1, the width (diameter) of the spacers 23 in the left-right direction is sufficiently smaller than the width W of the region in which the front end portion 13*a* and the back end portion 3*c* face each other in the left-right direction. The width (diameter) of the spacers 23 is ⅓ or less, preferably ¼ or less, of the width W of the region in which the front end portion 13*a* and the back end portion 3*c* face each other. The number of spacers 23 arranged in the circumferential direction around the winding center line O is no more than six, preferably four, and more preferably three as in the first embodiment.

The area of the spacers 23 along a plane perpendicular to the winding center line O is sufficiently smaller than the area of the entire region in which the front end portion 13*a* and the back end portion 3*c* face each other. The air passage P spreads over the entire area of the region in which the front end portion 13*a* and the back end portion 3*c* face each other excluding the areas of the spacers 23. Since the air passage P extends over the entire circumference around the winding center line O, even when the width δ of the gap between the front end portion 13*a* of the top yoke 13 and the back end portion 3*c* of the back portion 3*b* of the frame 3 in the front-back direction is reduced, the opening capacity of the air passage P can be increased to ensure effective ventilation between the magnetic gap G in which the voice coil 6 is disposed and the outside.

In the speaker 1 according to the first embodiment illustrated in FIG. 1, when a voice current is applied to the voice coil 6 wound around the bobbin 4, an electromagnetic force (magnetic energy) is induced in the magnetic gap G by the voice current and a magnetic field that extends through the space between the center pole 11 and the top yoke 13, and is converted into kinetic energy of the voice coil 6 in the Z1-Z2 direction. The kinetic energy is transmitted from the bobbin 4 to the vibrating plate 5. The vibrating plate 5 vibrates in the front-back direction in accordance with deformation of the damper member 9 and the edge member 7, so that acoustic energy is emitted forward (Z1 direction).

Since the damper member 9 is made of a material that is not air permeable, a space that is around the bobbin 4 and between the damper member 9 at the front and the bottom yoke 12 at the back serves as a space S that is substantially sealed except for the air passage P. The inner space of the bobbin 4 is also covered by the cap member 8 from the front. Therefore, when the bobbin 4 and the vibrating plate 5 vibrate in the front-back direction, the pressure in the space S varies so that an airflow A through the air passage P is generated between the region around the magnetic gap G in the space S and the outside, as illustrated in FIG. 1. The air passage P faces the outer peripheral portion of the voice coil 6 over the entire circumference thereof. Therefore, the entire body of the voice coil 6 is cooled by the airflow A. Thus, a cooling effect can be achieved in the region around the magnetic gap G without causing an uneven heat distribution in the circumferential direction. In addition, the flow rate of the airflow A is lower than that in an example of the related art in which, for example, grooves are formed, and the air noise can be reduced accordingly.

Figure 3:
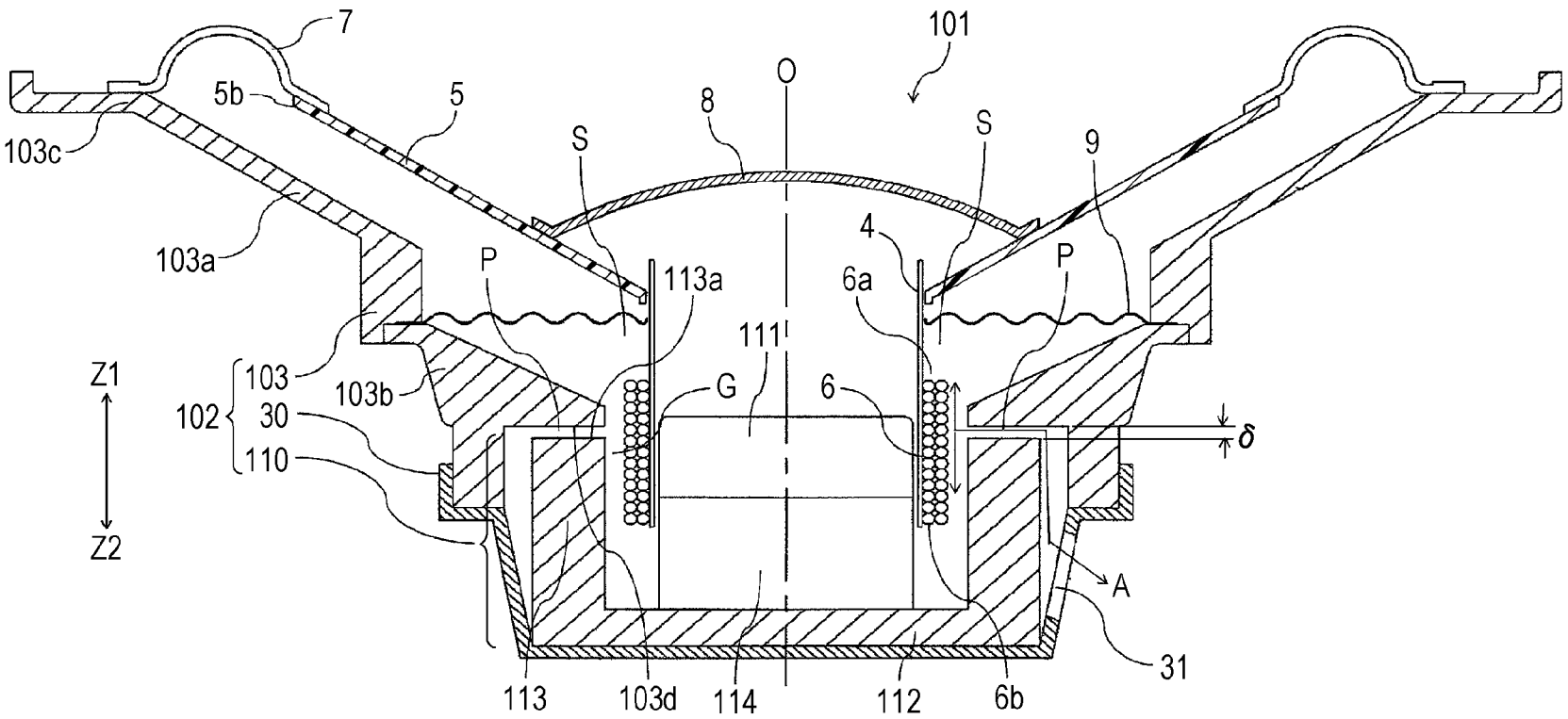
FIG. 3 is a sectional view of a speaker according to a second embodiment of the present invention oriented so that sound is emitted upward.

FIG. 3 illustrates a speaker 101 according to a second embodiment of the present disclosure. Components of the speaker 101 that are the same as those of the speaker 1 illustrated in FIG. 1 are denoted by the same reference numerals. In the speaker 101 illustrated in FIG. 3, a frame 103, a magnetic circuit unit 110, and a fixing member 30 form a support body 102.

The magnetic circuit unit 110 illustrated in FIG. 3 includes a bottom yoke 112 having the shape of a cylinder with a bottom. A magnet 114 is fixed to the front surface of a central portion the bottom yoke 112, and a center pole 111 is fixed to the front of the magnet 114. The magnet 114 has a solid cylindrical shape, and is magnetized so that a front surface (Z1-side surface) and a back surface (Z2-side surface) thereof have different magnetic poles. A magnetic gap G is formed between an inner peripheral surface of a tubular portion 113 of the bottom yoke 112 and an outer peripheral surface of the center pole 111. A voice coil 6, which is wound around a bobbin 4, is disposed in the magnetic gap G. The center pole 111 and the bottom yoke 112 are made of a magnetic metallic material.

The frame 103 is divided into a front portion 103*a* and a back portion 103*b*. A damper member 9, which is not air permeable, is provided between the bobbin 4 and the frame 103. An outer peripheral portion of the damper member 9 is secured by being clamped between the front portion 103*a* and the back portion 103*b*. An edge member 7 is provided between an edge portion 103*c* of the front portion 103*a* of the frame 103 and an outer peripheral portion 5*b* of a vibrating plate 5.

In the speaker 101 according to the second embodiment, the tubular portion 113 of the bottom yoke 112 serves as a first member of the support body 102, and the back portion 103*b* of the frame 103 serves as a second member.

The bottom yoke 112 of the magnetic circuit unit 110 and the back portion 103*b* of the frame 103 are retained and fixed by the fixing member 30. The fixing member 30 is preferably made of a non-magnetic metal or a synthetic resin material. The tubular portion 113 of the bottom yoke 112, which serves as the first member, includes a front end portion 113*a*, and the back portion 103*b* of the frame 103, which serves as the second member, includes a back end portion 103*d*. The bottom yoke 112 and the back portion 103*b* are fixed to the fixing member 30 in such a manner that a gap having a width δ in the front-back direction is provided between the front end portion 113*a* and the back end portion 103*d*.

The space in the gap having the width δ defines an air passage P having no obstacles over the entire area of the region in which the front end portion 113*a* and the back end portion 103*d* face each other. The air passage P faces the outer periphery of the voice coil 6 over the entire circumference of 360 degrees around the winding center line O.

The fixing member 30 has a plurality of openings 31. The openings 31 open at a location behind (on the Z2-side of) a Z2-side end portion of the back portion 103*b* of the frame 103. The air passage P communicates with the outside air through the openings 31.

In the speaker 101 illustrated in FIG. 3, when the bobbin 4 and the vibrating plate 5 vibrate in the front-back direction, the pressure in a space S, which is a space around the bobbin 4 and between the damper member 9 and the bottom yoke 112, varies so that an airflow A through the air passage P between the front end portion 113*a* and the back end portion 103*d* and through the openings 31 in the fixing member 30 is generated between the space S and the outside. The air passage P between the front end portion 113*a* and the back end portion 103*d* faces the voice coil 6 over the entire circumference of 360 degrees around the winding center line O, and has a large opening capacity. Therefore, a temperature increase in the magnetic gap G due to heat generated by the voice coil 6 can be effectively suppressed.

The first member and the second member in the two embodiments, which are components of the support body 2, 102, are not limited to a yoke or a portion of a frame. The first member and the second member may instead be components that are additionally provided.

The front end portion of the first member and the back end portion of the second member are preferably flat surfaces. However, at least one of the front end portion and the back end portion that face each other with a gap therebetween may have an irregular surface or shallow grooves as long as the front end surface and the back end surface have a gap therebetween in the front-back direction.

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

What is claimed is:

1. A speaker comprising:

a support body including a frame and a magnetic circuit unit fixed to the frame;

a vibrating plate supported by the frame in such a manner that the vibrating plate is capable of vibrating in a front-back direction;

a bobbin fixed to the vibrating plate; and a voice coil wound around the bobbin and disposed in a magnetic gap provided in the magnetic circuit unit, wherein the support body includes a first member and a second member located in front of the first member, the first member having a front end portion that faces forward, the second member having a back end portion that faces backward, and the first member and the second member are fixed so that the front end portion and the back end portion are spaced from each other in the front-back direction and have a gap provided between, the gap facing an outer periphery of the voice coil over substantially an entire periphery of the voice coil at least when the bobbin is stationary at a neutral position in the front-back direction, and wherein the first member and the second member are fixed with a spacer provided between the front end portion and the back end portion.

2. The speaker according to claim 1, wherein the gap faces the voice coil all around the voice coil.

3. The speaker according to claim 1, wherein the front end portion of the first member and the back end portion of the second member are both flat surfaces.

4. The speaker according to claim 1, wherein the first member is a yoke included in the magnetic circuit unit, and the second member is a portion of the frame.

5. The speaker according to claim 1, wherein the spacer is one of a plurality of spacers arranged around a winding center line of the voice coil with intervals therebetween.

6. The speaker according to claim 1, wherein at least one of the front end portion of the first member and the back end portion of the second member of the support body has an irregular surface or shallow grooves.

7. A speaker comprising:

a support body including a frame and a magnetic circuit unit fixed to the frame;

a vibrating plate supported by the frame in such a manner that the vibrating plate is capable of vibrating in a front-back direction;

a bobbin fixed to the vibrating plate; and a voice coil wound around the bobbin and disposed in a magnetic gap provided in the magnetic circuit unit between a circumferential yoke facing the voice coil and a center pole disposed within the bobbin, wherein the support body includes a first member comprising the circumferential yoke and a second member located in front of the first member, the first member having a front end portion that faces forward, the second member having a back end portion that faces backward, and the first member and the second member are fixed so that the front end portion and the back end portion are spaced from each other in the front-back direction and have a gap provided between, the gap facing an outer periphery of the voice coil over substantially an entire periphery of the voice coil at least when the bobbin is stationary at a neutral position in the front-back direction, and wherein the first member and the second member are fixed with a spacer provided between the front end portion and the back end portion.

8. The speaker according to claim 7, wherein the gap faces the voice coil all around the voice coil.

9. The speaker according to claim 7, wherein the front end portion of the first member and the back end portion of the second member are both flat surfaces.

10. The speaker according to claim 7, wherein the spacer is one of a plurality of spacers arranged around a winding center line of the voice coil with intervals therebetween.

11. The speaker according to claim 7, wherein at least one of the front end portion of the first member and the back end portion of the second member of the support body has an irregular surface or shallow grooves.

12. A speaker comprising:

a support body including a frame and a magnetic circuit unit fixed to the frame;

a vibrating plate supported by the frame in such a manner that the vibrating plate is capable of vibrating in a front-back direction;

a bobbin fixed to the vibrating plate; and a voice coil wound around the bobbin and disposed in a magnetic gap provided in the magnetic circuit unit, wherein the support body includes a gap leading to a space outside the speaker and facing an outer periphery of the voice coil all around the voice coil, at least when the bobbin is stationary at a neutral position in the front-back direction, and wherein a front end portion of a first member and a back end portion of a second member of the support body define the gap, and the first member and the second member are fixed together by a fixing member with the gap provided between the front end portion and the back end portion.

13. The speaker according to claim 12, wherein the front end portion of the first member and the back end portion of the second member of the support body are both flat surfaces.

14. The speaker according to claim 13, wherein the first member is a yoke included in the magnetic circuit unit, and the second member is a portion of the frame.

15. The speaker according to claim 12, wherein the fixing member includes a plurality of openings allowing airflow communication between the gap and the space outside the speaker.

16. The speaker according to claim 12, wherein at least one of the front end portion of the first member and the back end portion of the second member of the support body has an irregular surface or shallow grooves.

* * * * *